United States Patent [19]

Brotherston

[11] 4,292,012

[45] Sep. 29, 1981

[54] LIQUID FUEL INJECTION PUMPING APPARATUS

[75] Inventor: Collin P. Brotherston, Rainham, England

[73] Assignee: Lucas Industries Limited, Birmingham, England

[21] Appl. No.: 84,192

[22] Filed: Oct. 12, 1979

[30] Foreign Application Priority Data

Nov. 25, 1978 [GB] United Kingdom ..... 46082/78

[51] Int. Cl.[3] ..... F04B 19/00; F04B 29/00

[52] U.S. Cl. ..... 417/462

[58] Field of Search ..... 417/462, 252, 253

[56] References Cited

U.S. PATENT DOCUMENTS

| | | | |
|---|---|---|---|
| 3,936,233 | 2/1976 | Bonin | 417/462 |
| 3,936,244 | 2/1976 | Drorl | 417/462 |
| 4,098,249 | 7/1978 | Mowbray | 417/462 |
| 4,116,186 | 9/1978 | Drorl | 417/253 |
| 4,125,104 | 11/1978 | Stein | 417/462 |

FOREIGN PATENT DOCUMENTS

| | | | |
|---|---|---|---|
| 850353 | 4/1958 | United Kingdom | 417/253 |

*Primary Examiner*—William L. Freeh

[57] ABSTRACT

A rotary distributor fuel injection pumping apparatus has a rotary distributor member rotatable within a sleeve forming part of the body of the pumping apparatus. The distributor member includes a transverse bore which carries plungers movable inwardly by cam surfaces on a cam ring, as the distributor member rotates. The distributor member is movable axially in the body to vary the amount the plungers can move outwardly and therefore the amount of fuel delivered by the apparatus. The extent of outward movement is determined by complementary inclined surfaces formed on cam followers associated with the plungers and a part rotatable with the distributor member but axially fixed in the body.

24 Claims, 13 Drawing Figures

LIQUID FUEL INJECTION PUMPING APPARATUS

Figure 1:
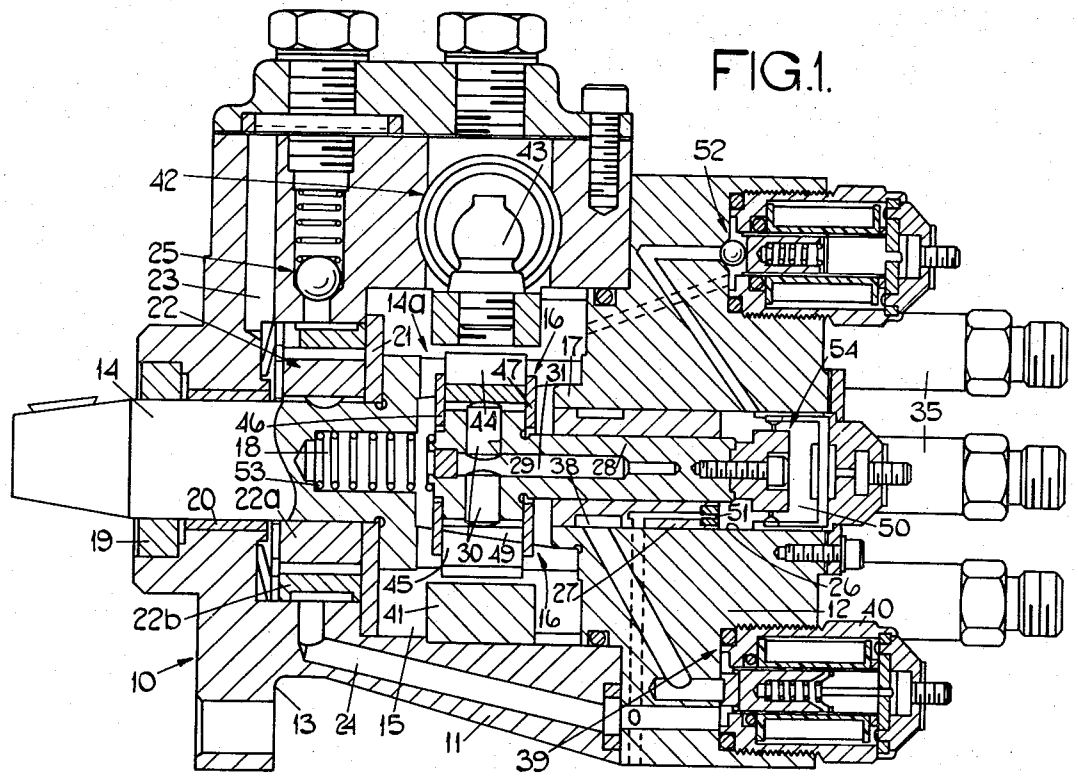

This invention relates to a liquid fuel injection pumping apparatus for supplying fuel to internal combustion engines and of the kind comprising a body part, a rotary distributor member mounted in the body part and arranged in use, to be driven in timed relationship with an engine with which the apparatus is associated, a transverse bore formed in the distributor member, a plunger in said bore, a cam follower positioned at the outer end of said plunger for engagement with a cam surface formed on a cam ring surrounding the distributor member, stop means for limiting the outward movement of the plunger, and passage means for conveying fuel to and from said bore during rotation of the distributor member.

In apparatus of the aforesaid kind, it is necessary to be able to vary the amount of fuel delivered by the apparatus in order to control the amount of fuel delivered to the associated engine. This can be achieved using a throttle through which fuel flows to the bore from a source of fuel under pressure. However, the amount of fuel flowing to the bore for a given setting of the throttle will vary as the speed of the engine varies. For example, as the engine speed increases the amount of fuel delivered to the engine each time the plunger is moved inwardly, will decrease. If on the other hand the engine speed is reduced then the amount of fuel delivered to the engine each time the plunger is moved inwardly, will increase and possibly the stop means will come into operation to determine the maximum quantity of fuel which can be delivered. In order to ensure that the amount of fuel delivered each time the plunger moves inwardly remains constant, the throttle must be adjusted each time there is a change in speed or the pressure of fuel upstream of the throttle must be varied. It is not therefore, very easy to provide a control member for the apparatus which when moved to a particular position will ensure that a pre-established quantity of fuel will be delivered to the engine whatever the engine speed.

Another way of obtaining variation of the amount of fuel delivered to the engine is to measure a quantity of fuel in a variable volume chamber in the body part and then to transfer the measured quantity of fuel to the bore. The measurement can be effected using a shuttle the stroke of which in the chamber can be adjusted directly for example by means of an adjustable stop. This arrangement in theory will provide for direct variation of the amount of fuel delivered during inward movement of the plunger in accordance with the setting of the adjustable stop. Unfortunately this form of apparatus suffers from problems in transferring the fuel from the chamber to the bore and in practice it is found that there may be considerable variation in the amount of fuel delivered for a given setting of the adjustable stop, as the speed of the associated engine varies.

It is also known to control the amount of fuel delivered during inward movement of the plunger by adjusting the stop means so that in effect the plunger acts as the aforesaid shuttle but without the practical problem of transferring the fuel to the bore. Such an apparatus is shown in the specification of British Pat. No. 1,171,226. In the apparatus shown in this specification a fork having an inclined surface for co-operation with a complimentary surface on the follower is provided and the fork is connected to or forms part of a sleeve which is mounted for axial movement upon a drive shaft which is rotatable with the distributor member. A problem with this arrangement is the fact that the sleeve rotates with the shaft and has to be connected for the purpose of adjustment, to an adjustable part fixed within the body part of the apparatus. Any lost motion between the sleeve and the aforesaid part can upset the calibration of the apparatus besides which the friction between the sleeve and the shaft will ensure that more effort is required to effect movement of the sleeve.

The object of the present invention is to provide an apparatus of the kind specified in a simple and convenient form.

According to the invention in an apparatus of the kind specified the distributor member is axially movable within the body part and the apparatus also comprises means for varying the axial setting of the distributor member within the body part and said stop means comprises complementary inclined surfaces on the follower and a part respectively which is rotatable with the distributor member but is axially fixed within the body part whereby as the distributor member is moved axially within the body part the amount by which the plunger can move outwardly whilst fuel is supplied to the bore will vary.

According to a further feature of the invention said part comprises a drive shaft driven in use by the associated engine, the apparatus including coupling means coupling the drive shaft to the distributor member, said coupling means allowing relative axial movement of the drive shaft and distributor member.

According to a still further feature of the invention resilient means is provided to bias the distributor member in one axial direction relative to the body part and lever means is provided and engageable with an end surface of the distributor member for moving the distributor member against the action of said resilient means.

Examples of apparatus in accordance with the invention will now be described with reference to the accompanying drawings in which:-

Figure 2:
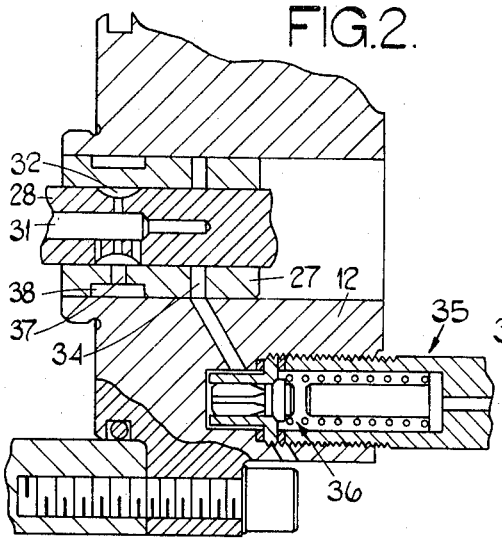
Figure 3:
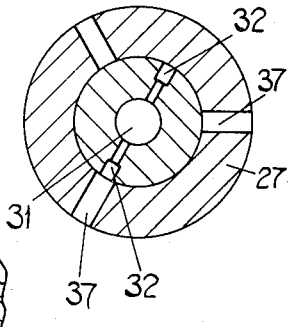
Figure 4:
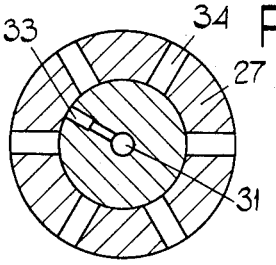
Figure 5:
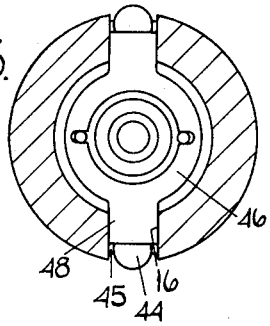
Figure 6:
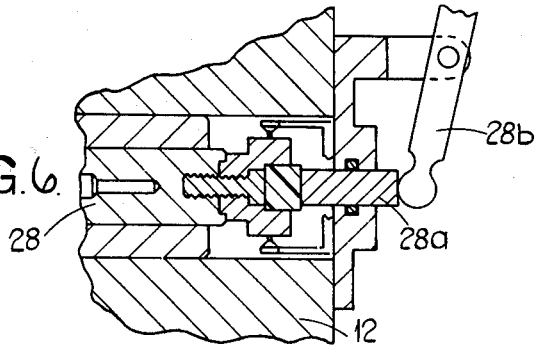
Figure 7:
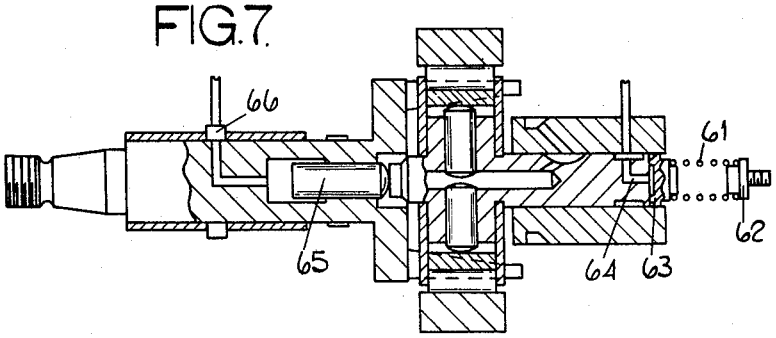
Figure 8:
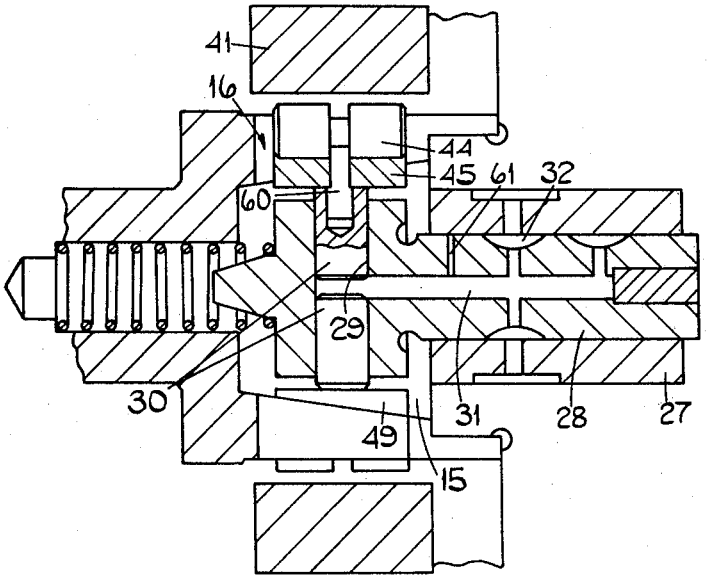
Figure 9:
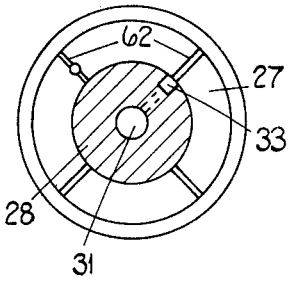
Figure 10:
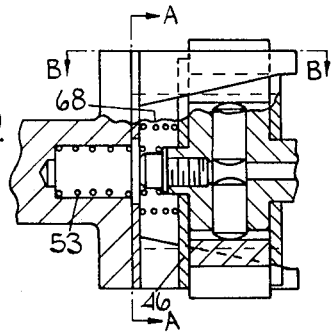
Figure 11:
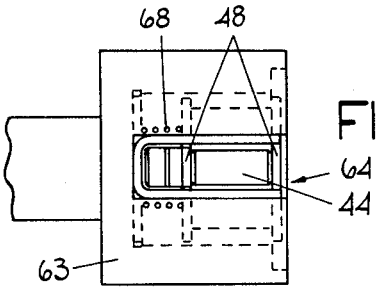
Figure 12:
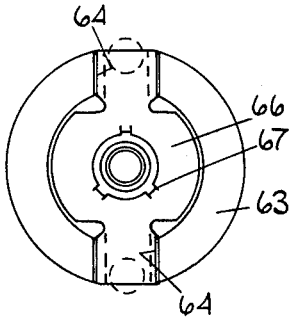
Figure 13:
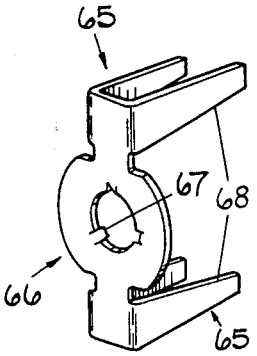

FIG. 1 is a sectional side elevation of one example of the apparatus,

FIG. 2 is a section of a part of the apparatus seen in FIG. 1 taken along a different radial plane, FIGS. 3 and 4 are sections through parts of the apparatus seen in FIGS. 1 and 2, FIG. 5 is a section through part of the apparatus seen in FIG.1, FIG. 6 is a section through a modified part of the apparatus of FIG. 1, FIG. 7 shows a further modification of the apparatus of FIG. 1, FIG. 8 is a sectional side elevation of another example of the apparatus, FIG. 9 is a section similar to FIGS. 3 and 4 at another said position of a modification to the example of FIGS. 1 and 8, FIG. 10 is a sectional side elevation of part of the apparatus of FIG. 1 showing a further modification, FIGS. 11 and 12 are views on the lines BB and AA of FIG. 10, and FIG. 13 is a perspective view of a part of the apparatus seen in FIG. 10.

Referring to FIG. 1 of the drawings, the apparatus comprises a body part generally indicated at 10 and which conveniently is formed by a generally cup shaped portion 11 the open end of which is closed by a closure portion 12. The body portion 10 is provided with apertured lugs 13 whereby in use the apparatus can be secured to the engine with which it is associated.

The body portion 11 mounts a rotary drive shaft 14 which in use, is coupled to a drive member of the associated engine so that the drive shaft is rotated in synchronism with the engine. The drive shaft 14 extends into the generally cylindrical chamber 15 defined by the two body portions and has an enlarged cup shaped portion 14*a* within the chamber. The enlarged portion is provided with a pair of diametrically disposed slots 16. The enlarged portion of the drive shaft is hollow and at its end remote from the smaller diameter portion of the shaft the inner surface is of right cylindrical form and locates about a spigot portion 17 defined by the body portion 12. The remainder of the interior surface of the enlarged portion of the drive shaft tapers for a purpose which will be described. Moreover, the drive shaft is provided with a counter bore 18. An oil seal 19 is provided at the outer end of the body portion 10 for engagement with the drive shaft 14 and a sleeve bearing 20 supports the shaft for rotation, the shaft being given additional support by the spigot 17. The shaft is located against axial movement by thrust surfaces which engage with the end surfaces of the enlarged portion of the shaft. In one case the thrust surface is defined directly by the body portion 12 whilst in the other case, the thrust surface is defined by an annular plate 21 which surrounds the drive shaft and which additionally serves as an end closure for a low pressure fuel supply pump 22. The rotor 22*a* of the supply pump is carried by the drive shaft 14 and the rotor in turn carries vanes which co-operate with an eccentrically disposed surface on a stator ring 22*b* which is carried within a body portion 11. The low pressure pump has a fuel inlet 23 connected to a fuel inlet 23*a* in a housing secured to the body portion 11 and a fuel outlet 24. Moreover, a relief valve 25 is provided to ensure that the output pressure of the pump remains within desired limits, the relief valve being connected between the inlet and the outlet.

Formed in the body portion 12 is a cylindrical bore 26 in which is fixed a sleeve 27. The sleeve 27 accommodates an angularly and axially movable distributor member 28 which projects into the chamber 15 and has an enlarged head portion lying within the chamber. Formed in the head portion of the distributor member is a transversely extending bore 29 in which is located a pair of pumping plungers 30. The bore 29 communicates with a blind passage 31 formed in the distributor member and which at its end within the head portion is sealed by means of a plug. As is more clearly shown in FIGS. 2, 3 and 4 the passage 31 communicates with a pair of diametrically disposed longitudinal slots 32 formed in the periphery of the distributor member and communicating with the passage 31 by means of a single or a plurality of connecting passages. The passage 31 also communicates with a further longitudinal slot 33 formed in the periphery of the distributor member and this slot communicates in turn with a plurality of outlet ports 34 formed in the sleeve 27 and as seen in FIG. 2, the outlet ports 34 communicate with outlets 35 respectively in the body portion 12. Each outlet incorporates a conventional form of delivery valve 36. The slots 32 register in turn with inlet ports 37 formed in the sleeve 27 and communicating with a circumferential groove 38 formed in the periphery of the sleeve. The groove 38 as shown in FIG. 1, communicates with the outlet 24 of the low pressure pump 22 by way of an on/off valve 39 conveniently controlled by an electromagnetic device 40. If desired a single slot 32 may be provided with the number of inlet ports being equal to the number of outlets.

Surrounding the head portion of the distributor member 28 is an annular cam ring 41 on the internal peripheral surface of which are formed pairs of diametrically disposed cam lobes. In the particular example three pairs of lobes are provided since the apparatus is intended to supply fuel to a six cylinder engine. Moreover, the cam ring 41 is angularly movable about the axis of rotation of the distributor member by means of a fluid pressure operable device generally indicated at 42 and connected to the cam ring by way of a radially disposed peg 43. The device 42 conveniently includes a resiliently loaded piston housed within a cylinder to one end of which liquid under pressure can be supplied to act on the piston to urge the piston against the action of its resilient loading.

Positioned at the outer ends of the plungers are a pair of followers each of which comprises a roller 44 carried in a shoe 45. The followers are retained axially relative to the distributor member by a pair of side plates 46, 47 which are secured to the side faces of the head portion of the distributor member. Conveniently as shown in FIG. 5, the side plates are of annular form and have a pair of outwardly extending tongues 48, which locate in the slots 16 formed in the enlarged portion of the drive shaft. In FIG. 5 the plate 46 is seen, the plates acting to transmit rotary motion to the distributor member from the drive shaft. The shoes 45 are also located within the aforesaid slots 16 and the rotary motion is transmitted to the shoes directly by the drive shaft. Moreover, the circumferential side faces of the shoes are provided with circumferentially extending projections 49 the radially outer surfaces of which are tapered to co-operate with the tapered surface formed on the internal surface of the enlarged portion of the drive shaft 14.

In use, when fuel is supplied to the bore 29, upon registration of a groove 32 with an inlet passage 37, the plungers 30 are moved outwardly by the fuel pressure and in so doing impart outward movement to the shoes 45 and the rollers 44. The outward movement is limited by the abutment of the tapered surfaces on the shoes and shaft and by moving the distributor member axially the extent of outward movement can be varied. Thus the amount of fuel supplied to the bore 29 can be controlled and this in turn determines the amount of fuel delivered through an outlet when the plungers 30 are moved inwardly by a pair of cam lobes.

The axial position of the distributor member can be varied mechanically or hydraulically. In the arrangement described the variation is achieved by varying the pressure within a chamber 50 defined by the end of the bore 26 in the body portion 12. The end of the bore 26 is closed by a closure member and fuel under pressure is supplied to the chamber 50 by way of a restricted orifice 51 carried by the sleeve 27. The orifice 51 communicates with the outlet 24 of the pump 22. Fuel is allowed to escape from the chamber 50 so that the pressure in the chamber can be controlled, by way of an electromagnetically controlled valve 52. Moreover, the distributor member is biased by means of a coiled compression spring 53 which is housed within the blind bore 18 formed in the drive shaft 14. The spring 53 acts between the drive shaft and the distributor member and urges the distributor member against the action of fuel under pressure in the chamber 50 which acts on the distributor member.

By varying the pressure in the chamber 50 using the valve 52 so the axial position of the distributor member can be varied and therefore the amount of fuel delivered each time the plungers move inwardly can be varied.

For a given axial setting the distributor member and ignoring leakage, the amount of fuel delivered by the plungers will remain the same throughout the speed range of the associated engine and an indication of the axial setting of the distributor member, is provided by a position transducer 54 which is carried on the end closure for the bore 26 and may be adjustably mounted thereon for the purpose of calibration. Conveniently the transducer has a part which is carried by the distributor member. The signal provided by the position transducer can be utilised to provide a signal indicative of the speed of rotation of the distributor member and also a signal indicative of its axial position and therefore the amount of fuel being delivered by the apparatus. In use, the signals will be supplied to an electronic control system which additionally is provided with signals representing various engine operating parameters and the desired engine speed. The control system controls the operation of the valve 52 to ensure that the correct amount of fuel is supplied to the associated engine.

Alternatively the axial setting of the distributor member may be achieved by mechanical means including for example a push member 28*a* engaging with the end of the distributor member remote from the spring 53, the push member being engaged by a lever 28*b* as seen in FIG. 6. In this case the valve 52 and the orifice 51 are omitted.

In each case the effort required to move the distributor member is largely that represented by the spring 53 because any friction between the distributor member 28 and the sleeve 27 will be at a minimum in view of the relative rotation of these two parts.

In the arrangement shown in FIG. 1 in the event that the pressure in the chamber 50 should fail for any reason then the distributor member 28 will be moved by the spring 53 to the position in which the maximum amount of fuel will be supplied by the apparatus. This could result in damage to the associated engine. In order to prevent this and as shown in FIG. 7 the spring 61 is positioned at the opposite ends of the distributor member and urges the distributor member to the minimum fuel position. One end of the spring engages an adjustor 62 whereby the force exerted by the spring can be adjusted and the other end of the spring engages a thrust pad 63 which biases against the distributor member. The thrust pad may be constructed from a hard wearing synthetic resin material or as shown, it may be formed from metal and separated from the distributor member by a film of fuel which is supplied from the passage 64 connected by way of a resistor to the outlet of the low pressure pump.

The opposite end of the distributor member is engaged by a piston 65 which is located within a cylinder formed in the drive shaft 14. Fuel under pressure is applied to the piston the fuel being obtained from the outlet of the low pressure pump by way of a restrictor and controlled by a valve similar to the valve 52. In this arrangement the pressure applied to the piston must be increased to increase the quantity of fuel delivered to the engine. Conveniently the supply of fuel under pressure to the cylinder containing the piston takes place by way of a passage in the distributor member which opens onto the periphery of the distributor member for communication with a circumferential groove 66 defined between the adjacent ends of a pair of sleeves forming the bearing sleeve 20. Thus if excessive wear of the sleeves takes place leakage of fuel will take place and the pressure applied to the piston will fall thereby reducing the amount of fuel supplied to the associated engine. The only disadvantage with this arrangement is that the piston may stick. However, in use the drive shaft will be subject to torsional vibration and also speed variation which will tend to result in relative angular movement of the piston and the drive shaft.

A modification of the way in which the distributor member is driven and the rollers and shoes retained relative to the distributor member is shown in FIG. 8. In FIG. 8 the outer ends of the plungers 30 are provided with blind bores which accommodate pins extending inwardly from the followers. The pins are referenced 60 and are of stepped form. The wider ends of the pins are located within the bores in the plungers whilst the narrower ends extend through apertures in the shoes 45 and terminate in circumferential grooves formed in the rollers 44. The shoes 45 engage the faces of the slots 16 as in the previous example and the rotary motion is transmitted to the distributor member through the pins 60 and the plungers 30. The pins also act to locate the followers and rollers against axial movement.

FIG. 8 also shows a modification in that there is provided in communication with the passage 31 a radial passage 61 which extends to the periphery of the distributor member and which is normally covered by the sleeve 27 except when the distributor member is set to provide minimum or zero fuel. In this position the distributor member will be moved to the extreme left to a position in which the rollers may not engage the cam lobes but even if they do engage the cam lobes as may be the case where the cam lobes are of a special shape to control the retraction of fuel at the end of delivery, any inward movement causing displacement of fuel from the bore in which the plungers are located, will result in that fuel flowing into the chamber 15 by way of the passage 61 and not to the associated engine.

This passage can also be utilised to assist the purging of the apparatus of air after manufacture or servicing of the apparatus or in the event that air has been allowed to enter into the various passages of the apparatus. It is anticipated however, that if this facility is required then the passage connecting the grooves 32 with the passage 31 will have to be connected to the passage 31 at positions adjacent the bore 29. In this event fuel supplied by the low pressure pump will be delivered to the passage 31 adjacent the bore 29 and any air bubbles entrained with the fuel will pass along the passage 31 and through the passage 61.

It may be preferable to provide for purging of air within the apparatus when the distributor member is set to provide excess fuel for starting purposes. In this case and as shown in FIG. 9 which shows a portion of an apparatus for supplying fuel to a four cylinder engine, the sleeve 27 is provided with a plurality of passages 62 at angular positions corresponding to the positions of the outlet ports 34. The passages 62 are of a restricted size and are at an axial position such that when the distributor member is in the excess fuel position, the longitudinal slot 33 can register in turn therewith. The inner ends of the passages 62 communicate with the longitudinal passage 31 and hence during inward movement of the plungers some fuel will flow along one of the passages 62 but during normal conditions fuel will also be delivered to the respective outlet. When air is present in the passages the pressure of fuel developed during inward movement of the plungers may not be sufficient to lift the delivery valve in the outlet and fuel and air will then flow through the passages 62 in turn until the passages within the distributor member are purged of air.

If at the zero fuel position of the distributor member it is required to ensure that no fuel flows through the outlet ports 34 it will still be necessary to provide the passage 61 previously described.

In the arrangement shown in FIGS. 1 and 8 the portion of the drive shaft which surrounds the distributor member and in which also the slots 16 are formed, has a tapered internal surface. The production of this tapered surface presents difficulties. In order to facilitate the production of the drive shaft the construction shown in FIGS. 10–13 has been proposed. In this construction the aforesaid portion 63 of the drive shaft has a right cylindrical internal surface and formed in the portion 63 is a pair of dimetrical slots 64. The slots 64 each accommodate a pair of stop members formed by the limbs of a "U" shaped portion 65. The "U" shaped portions are part of a sheet metal pressing shown in perspective view in FIG. 13. The two "U" shaped portions are interconnected by a connecting portion 66 which is of generally annular form and which is located against the base wall of the portion 63. The spring 53 extends through the aperture in the connecting portion 66 and the internal peripheral surface of the connecting portion has three raised tangs 67 thereon which locate one end of a light coiled compression spring 68 the opposite end of which bears against the adjacent side plate 46. As in the example of FIG. 1 the side plates 46 and 47 are provided with tangs 48 which are located between the "U" shaped portions 65 respectively and which transmit rotary motion to the distributor member. As will be seen from FIG. 13 the radially inner edges 68 of the limbs of the "U" shaped members taper outwardly away from the connecting portion and these edges co-operate with the inclined surfaces on the shoes which support the rollers, to limit the outward movement of the plungers. The light spring acts to urge the connecting portion 66 into contact with the base wall of the portion 63 of the drive shaft and in so doing it assists the action of the spring 53. The surfaces of the tapered edges of the limbs of each "U" shaped member lie in the same plane and so also do the inclined surfaces on the shoes. Hence the production of the inclined surfaces on the shoes is also facilitated since these are flat and no longer have to be curved to correspond with the internal surface of the enlarged portion of the drive shaft.

As an alternative to the use of a separate "U" shaped portion 65, the enlarged portion of the drive shaft 14 which is of cup-shaped form in the examples described can be constructed in a special way. Starting from a solid piece of material of right cylindrical form, a diametrical slot is formed which forms the equivalent of the slots 16. Next using a broaching tool at right angles to the aforesaid slot a shaped slot is produced which extends at right angles to the aforesaid slot. This slot has a base wall in which will be formed the counter bore 18 and has side walls which conform to the shape of the edges 68 of the limbs of the "U" shaped portions. The enlarged portion of the drive shaft in effect comprises a diametrically disposed plate with four axially extending projections. Each projection has a side face for engagement with a side face of a shoe and a further side face which whilst it lies in a plane at right angles to the plane of the first side face is inclined to the axis of rotation. This surface is engaged by the projections 49 on the shoes.

I claim:

1. A liquid fuel injection pumping apparatus for supplying fuel to internal combustion engines and of the kind comprising a body part, a rotary distributor member mounted in the body part and arranged in use to be driven in timed relationship with an engine with which the apparatus is associated, a transverse bore formed in the distributor member, a plunger in said bore, a cam follower positioned at the outer end of said plunger for engagement with a cam surface formed on a cam ring surrounding the distributor member, stop means for limiting the outward movement of the plunger, passage means for conveying fuel to and from said bore during rotation of the distributor member characterised in that said distributor member is axially movable within the body part, the apparatus including means for varying the axial setting of the distributor member within the body part, and said stop means comprises complementary inclined surfaces on the follower and a part respectively, said part being rotatable with the distributor member but axially fixed within the body part whereby as the distributor member is moved axially within the body part the amount by which the plunger can move outwardly whilst fuel is supplied to the bore will vary.

2. An apparatus according to claim 1 in which said part comprises a drive shaft driven in use by the associated engine, the apparatus including coupling means coupling the drive shaft to the distributor member, said coupling means allowing relative axial movement of the drive shaft and distributor member.

3. An apparatus according to claim 2 including resilient means acting to bias the distributor member in one axial direction relative to the body part and lever means engageable with an end surface of the distributor member for moving the distributor member against the action of said resilient means.

4. An apparatus according to claim 2 in which said drive shaft includes an enlarged portion surrounding the part of the distributor member in which said transverse bore is formed, said enlarged portion having a slot therein in register with said plunger in which is located said follower, said coupling means comprising a pin connecting said plunger to said follower whereby rotary motion is imparted to the distributor member from said enlarged portion of the drive shaft by way of said follower, the pin and the plunger.

5. An apparatus according to claim 2 including resilient means acting to bias the distributor member in one axial direction relative to the body part, a surface formed on the distributor member or on a further part operatively connected thereto, and means for providing a control pressure which acts on said surface to oppose the force exerted by said resilient means.

6. An apparatus according to claim 5 in which said resilient means acts intermediate the drive shaft and the distributor member, said surface being defined by the end of the distributor member remote from said drive shaft.

7. An apparatus according to claim 6 in which said resilient means is partly located within a counter bore formed in the drive shaft.

8. An apparatus according to claim 5 including a counter bore in the drive shaft, a piston slidable within said counter bore and engaging with the adjacent end of the distributor member, passage means through which said control pressure can be supplied to said bore to act on said piston, said resilient means acting upon the opposite end of the distributor member.

9. An apparatus according to claim 8 in which said passage means includes a passage in the drive shaft and a circumferential supply groove defined in a bearing sleeve for the drive shaft, said passage and supply groove being in register.

10. An apparatus according to claim 8 including a thrust pad positioned intermediate the resilient means and the distributor member.

11. An apparatus according to claim 10 including means for forming a film of liquid between the distributor member and the thrust pad.

12. An apparatus according to claim 2 in which said drive shaft includes an enlarged portion surrounding the part of the distributor member in which said transverse bore is located, said enlarged portion having a slot therein in register with said plunger and in which is located said follower, said coupling means comprising a plate carried by the distributor member and having a tang located in said slot.

13. An apparatus according to claim 12 in which said cam follower comprises a roller and a shoe supporting the roller, said surfaces being defined on side projections on the shoe and by the internal surface of the enlarged portion of the drive shaft.

14. An apparatus according to claim 13 in which the internal surface of the enlarged portion of the drive shaft tapers outwardly from the smaller portion of the drive shaft.

15. An apparatus according to claim 14 comprising a pair of said plates, said plates acting to retain said shoe and roller in fixed axial relationship to the distributor member.

16. An apparatus according to claim 12 in which said cam follower comprises a roller and a shoe supporting the roller, said surfaces being defined on side projections on the shoe and by the edges of stop members located in said slot.

17. An apparatus according to claim 16 in which said stop members are interconnected to form a "U" shaped portion.

18. An apparatus according to claim 17 in which two plungers are provided in the bore, each plunger having a shoe and roller associated therewith and there being a pair of slots formed in the enlarged portion of the drive shaft each of said slots accommodating a "U" shaped portion, the two portions being integrally formed with a connecting portion from sheet material.

19. An apparatus according to claim 18 in which the inner edge of each stop member tapers outwardly from the smaller portion of the drive shaft, the surfaces formed by the tapered inner edges of each "U" shaped member lying in the same plane, and the surface on said projections being substantially flat.

20. An apparatus according to claim 19 in which said connecting portion is held adjacent the base wall of the enlarged cup shaped portion of the drive shaft by a coiled compression spring interposed between the distributor member and the connecting portion.

21. An apparatus according to claim 1 in which said passage means includes a delivery passage in the distributor member in communication with said bore and a plurality of outlets in the body part with which the delivery passage registers in turn as the distributor member rotates during the time fuel flows from the bore, an inlet port in the body part and a plurality of inlet passages in the distributor member which are in communication with the bore said inlet passages registering in turn with said inlet port to permit fuel to flow to the bore when the plunger is allowed to move outwardly and a source of fuel under pressure connected to said inlet port.

22. An apparatus according to claim 1 in which said passage means includes a delivery passage in the distributor member in communication with said bore and a plurality of outlets in the body part with which the delivery passage registers in turn as the distributor member rotates during the time fuel flows from the bore, a plurality of inlet ports in the body part and an inlet passage in the distributor member which is in communication with the bore said inlet passage registering in turn with said inlet ports to permit fuel to flow to the bore when the plunger is allowed to move outwardly and a source of fuel under pressure connected to said inlet port.

23. An apparatus according to claim 21 or 22 including a further passage in the distributor member and which extends to the periphery of the distributor member at a position so that it is covered by the distributor member except when the distributor member is in the minimum fuel position.

24. An apparatus according to claim 22 or claim 23 including restricted passages formed in the body part at positions such that they are angularly aligned with the outlets respectively but are axially offset such that when the distributor member is set to provide an excess of fuel for starting purposes the delivery passage besides communicating with an outlet, will also communicate with the respective restricted passage.

* * * * *